US009599961B2

(12) United States Patent
Stranczl

(10) Patent No.: US 9,599,961 B2
(45) Date of Patent: Mar. 21, 2017

(54) TOURBILLON MECHANISM

(71) Applicant: Nivarox-FAR S.A., Le Locle (CH)

(72) Inventor: Marc Stranczl, Nyon (CH)

(73) Assignee: Nivarox-FAR S.A., Le Locle (CH)

( * ) Notice: Subject to any disclaimer, the term of this patent is extended or adjusted under 35 U.S.C. 154(b) by 0 days.

(21) Appl. No.: 14/955,597

(22) Filed: Dec. 1, 2015

(65) Prior Publication Data

US 2016/0161915 A1 Jun. 9, 2016

(30) Foreign Application Priority Data

Dec. 3, 2014 (EP) ..... 14196157

(51) Int. Cl.
*G04B 17/28* (2006.01)
*G04B 31/00* (2006.01)

(52) U.S. Cl.
CPC ..... *G04B 17/285* (2013.01); *G04B 31/00* (2013.01)

(58) Field of Classification Search
CPC ..... G04B 17/285; G04B 15/00; G04B 15/14
See application file for complete search history.

(56) References Cited

U.S. PATENT DOCUMENTS 8,882,339 B2 * 11/2014 Colpo ..... G04B 15/06 368/127
9,075,394 B2 * 7/2015 Stranczl ..... G04B 15/00
2010/0046329 A1 2/2010 Greubel et al.

FOREIGN PATENT DOCUMENTS

CH 707 808 A2 9/2014
GB 2 375 619 11/2002
WO WO 2008/125503 A1 10/2008
WO WO 2011/006617 A1 1/2011

OTHER PUBLICATIONS

Machine Translation of CH 707808.*
European Search Report issued Sep. 30, 2015 in European Application 14196157, filed on Dec. 3, 2014 ( with English Translation).

* cited by examiner

*Primary Examiner* — Amy Cohen Johnson
*Assistant Examiner* — Jason Collins
(74) *Attorney, Agent, or Firm* — Oblon, McClelland, Maier & Neustadt, L.L.P.

(57) ABSTRACT

A tourbillon mechanism for a timepiece movement includes a balance mechanism, an escapement mechanism and a carriage mounted in a structure of the timepiece movement in rotation about a tourbillon axis. The balance mechanism includes a spring and a balance wheel mounted in the carriage to pivot about the tourbillon axis. The escapement mechanism includes an escape wheel with teeth and a pallet-lever including pallet-stones configured to engage the teeth, the pallet-lever being mounted in the carriage and coupled in rotation to the carriage by a pivot device. The escape wheel encircles the tourbillon axis and is attached to or integral with the structure of the timepiece movement.

13 Claims, 3 Drawing Sheets

TOURBILLON MECHANISM

This application claims priority from European patent application No. 14196157.3 filed Dec. 3, 2014, the entire disclosure of which is hereby incorporated herein by reference.

The present invention concerns a tourbillon mechanism for timepiece movements.

Some timepiece movements include a tourbillon mechanism. It is known that the rate of a watch differs according to the vertical position in which it is observed. This is essentially caused by the disequilibrium or unbalance of the balance wheel and that of the balance spring. To eliminate these differences in rate, the centre of gravity of the sprung balance system must be at the centre of rotation of these elements and maintained there during oscillations. The object of a tourbillon mechanism is not to eliminate these differences, but to compensate for them. To achieve this, the escapement-balance assembly is placed in every position and subjected to a rotation which is generally one revolution per minute. In these conditions, a mixture of vertical positions is obtained, which ultimately results in a mean rate. The tourbillon regulating mechanism is generally formed of an escapement comprising a sprung balance assembly mounted in a rotating carriage suspended between two pivot points. One of the drawbacks of known tourbillon mechanisms is their large size, and particularly their thickness which is due to the superposition, along the axis of rotation of the carriage, of the sprung balance and a conventional escapement mechanism.

It is often sought to reduce the thickness of watch movement components, for example for aesthetic reasons. There is also a constant desire to increase the efficiency of timepiece movements and to reduce the wear of the component parts of the movement.

It is an object of the invention to provide a compact tourbillon mechanism, especially of small thickness, for a timepiece movement.

It is another object of the invention to provide a tourbillon mechanism with low inertia.

Another object of the invention is to provide a highly efficient tourbillon mechanism for a timepiece movement.

It is another object of the invention to provide a tourbillon mechanism for a timepiece movement that is economical and easy to manufacture.

Yet another object of the invention is to provide a tourbillon mechanism for a timepiece movement which has very low energy consumption.

Yet another object of the invention is to provide a tourbillon mechanism for a timepiece movement which is robust.

The objects of the invention are achieved through a tourbillon mechanism for a timepiece movement according to claim 1. The dependent claims describe advantageous aspects of the invention.

In the present invention there is described a tourbillon mechanism for a timepiece movement, comprising a balance mechanism, an escapement mechanism and a carriage mounted in a structure of the timepiece movement rotating about a tourbillon axis. The balance mechanism includes a spring and a balance wheel mounted in the carriage to pivot about said tourbillon axis. The escapement mechanism includes an escape wheel with teeth and a pallet-lever comprising pallet-stones configured to engage said teeth, the pallet-lever being mounted in the carriage and coupled in rotation to the carriage by means of a pivot device. The escape wheel encircles the tourbillon axis and is attached to or integral with said structure of the timepiece movement. The pivot device is configured to pivot elastically and support the pallet-lever.

In one embodiment, the pivot device includes one or more elastic arms connecting the pallet-lever to an anchoring area joined to the carriage or integral therewith.

In one embodiment, the pivot device includes a pair of said elastic arms.

In one embodiment, the pair of elastic arms may define a substantially triangular shape with the anchoring area. In one embodiment, the elastic arms may have the same length and the same geometry.

In one embodiment, the pallet-lever pivots about a virtual axis of rotation located at the intersection of neutral fibres of the elastic arms.

In one embodiment, the escape wheel teeth point outwards from the wheel and the pallet-stones are disposed radially on the outside of the escape wheel and point towards the inside of the wheel.

The carriage may be connected to an energy source providing a rotational torque on the carriage, the energy source being coupled to the carriage by means of a drive train meshing with a pinion that is attached to or integral with the carriage.

In one embodiment, the set of elements integral with the pivot device may include one or more of the following elements: part of the pallet-lever or the entire pallet-lever; part of the carriage or the entire carriage; the spring of the balance mechanism. The pivot device or set of elements integral with the pivot device may form a one-piece structure.

In one embodiment, the pivot device includes a bistable mechanism.

In one embodiment, the pivot device or a set of elements integral with the pivot device may be formed by deposition or etching methods.

In some embodiments, the pivot device or set of integral elements may notably be formed by a LIGA method.

In some embodiments, the pivot device or set of integral elements may notably be made of a silicon-based material.

In some embodiments, the pivot device or set of integral elements may notably be formed by a silicon-on-insulator (SOI) method. In this variant, the structure is formed of a stack of a silicon layer on an insulator layer. This insulator may be for example silicon dioxide ($SiO_2$).

In some embodiments, the pivot device or set of integral elements may notably be made of Ni, NiP or an amorphous metal.

The pivot device or set of integral elements may also comprise sacrificial structures to assist assembly.

Other advantageous objects and aspects of the invention will appear upon reading the claims, and the detailed description of embodiments below, and the annexed drawings, in which:

Figure 1:
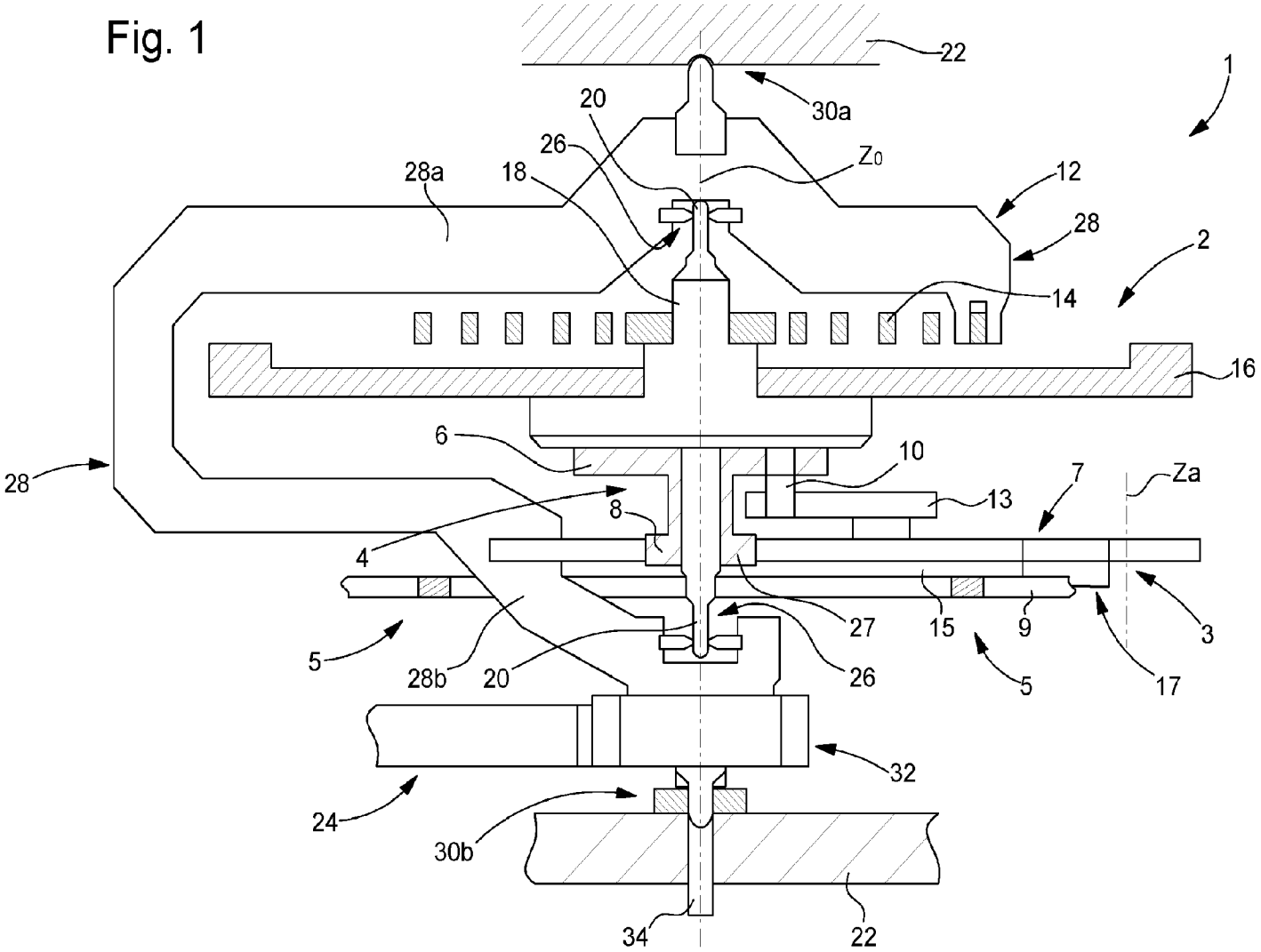
FIG. 1 is a schematic view of a tourbillon mechanism for a timepiece mechanism, according to an embodiment of the invention.

Referring to the Figures, a tourbillon mechanism for a timepiece movement includes a balance mechanism 2 and an escapement mechanism 3 mounted in a carriage 12.

Balance mechanism 2 includes a spring 14 and a balance wheel 16 secured on an arbor 18 mounted to pivot inside carriage 12. The opposite ends 20 of the arbor are housed in bearings 26 disposed in opposite walls 28*a*, 28*b* of carriage 12. A spring 14, which, in the illustrated embodiment is spiral-shaped, is secured by a first end to arbor 18 (or directly to the balance wheel), and by its other end to carriage 12 so as to apply a relative elastic rotational force between balance wheel 16 and carriage 12.

The escapement mechanism comprises an escape wheel 5 provided with teeth 9, a pallet-lever 7, and a roller device 4 coupled to balance 2.

The pallet-lever includes a fork 13, pallet-stones 17*a*, 17*b*, and a lever 15 connecting the pallet-stones to the fork. The lever is coupled in rotation to carriage 12 by means of an elastic pivot device 11 which will be described in more detail below. Lever 15 and pallet-stone 17 pivot about a virtual axis of rotation Za located, in the example shown, between pallet-stones 17*a*, 17*b* approximately at the intersection of the neutral fibres of the elastic strips.

The pallet-stones cooperate with the escape wheel teeth 9. One pallet-stone forms the entry pallet 17*a* and the other forms the exit pallet 7*b*. The pallet-lever further includes a guard-pin 27 fixed to the fork by means, for example, of a pin pressed in or bonded inside a securing hole at the base of the fork. The roller device 4 includes a table roller 6 with an impulse pin 10 that engages the horns of fork 13 and a small roller 8 provided with a passing-hollow 16 for the passage of guard-pin 27. The illustrated mechanism operates in accordance with the principle of a Swiss lever escapement. As this principle is well known per se, the conventional elements and the operation thereof will not be described in more detail here.

The escape wheel teeth 9 point outwards from the wheel and the pallet-stones 17*a*, 17*b* are disposed radially on the outside of the escape wheel and point inwards, namely towards the axis of rotation of the tourbillon carriage. This advantageously makes it possible to increase the length of elastic arms 21 of pivot device 11 while providing a compact escapement mechanism. Carriage 12 is mounted to rotate, by means of bearings 30*a*, 30*b*, in a frame 22 or fixed structure of the timepiece movement. Carriage 12 is connected to an energy source providing a rotational torque on the carriage. This energy source may be coupled to the carriage by means of a drive train 24 meshing with a pinion 32 that is attached to or integral with the body of carriage 12. A seconds arbor 34 may be attached to or integral with carriage 12, for example extending from the centre of pinion 32 through bearing 30*b*, and aligned with axis of rotation $Z_0$ of carriage 12. A seconds display hand (not illustrated) may be secured to the free end of seconds arbor 34. Other configurations are however possible, for example the seconds display may be coupled by a gear train device (not illustrated) to pinion 32 or to another wheel integral with or secured to carriage 12.

The component parts of balance mechanism 2 together with pallet-lever 7 of escapement mechanism 3 are carried by carriage 12 and thus rotate with the carriage with respect to frame 22 or to a fixed structure of the timepiece movement. Escape wheel 5 is attached to or integral with the frame or a fixed structure of the timepiece movement.

While the balance wheel describes its arc of oscillation and one of pallet-stones 17*a*, 17*b* engages one tooth 9 of escape wheel 5, carriage 12 remains still, together with escapement mechanism 3 and drive train 24. Although the carriage is subject to the drive force that acts on the carriage pinion 32, no rotation is possible because pallet-lever 7, which is secured to the body of carriage 12, is stopped against a tooth of escape wheel 5 which is in fixed relation with the frame.

As soon as pallet-stone 17*a*, 17*b* is released from an escape wheel tooth, carriage 12 turns through a small angle, for example an angle equal to the displacement of the seconds hand, and is immediately immobilised when the escapement functions end and one of pallet-stones 17*a*, 17*b* is again stopped against a tooth 9 of escape wheel 5. After this displacement, the assembly carried by carriage 12 occupies a new locking position.

During the rotation of carriage 12, pinion 32 is driven in a rotational movement, caused by the meshing thereof in the toothing of drive train 24.

Balance mechanism 2 is located inside and in the axis of rotation of carriage 12 and its pivots rotate in bearings integral with the carriage. As regards the other parts of the escapement, with the exception of escape wheel 5, these parts pivot with carriage 12. Thus, in a relatively short period of time, for example in one minute, in a series of jumps, the entire carriage 12 will have completed one revolution, driving with it all the members that it carries. It is known that the rate of a watch differs according to the vertical position in which it is observed, essentially caused by the disequilibrium or unbalance of the balance wheel and that of the spring. By placing the balance device in every rotational position, for example in one revolution per minute, a mixture of vertical positions is obtained which results in a mean rate compensating for such differences.

Figure 2:
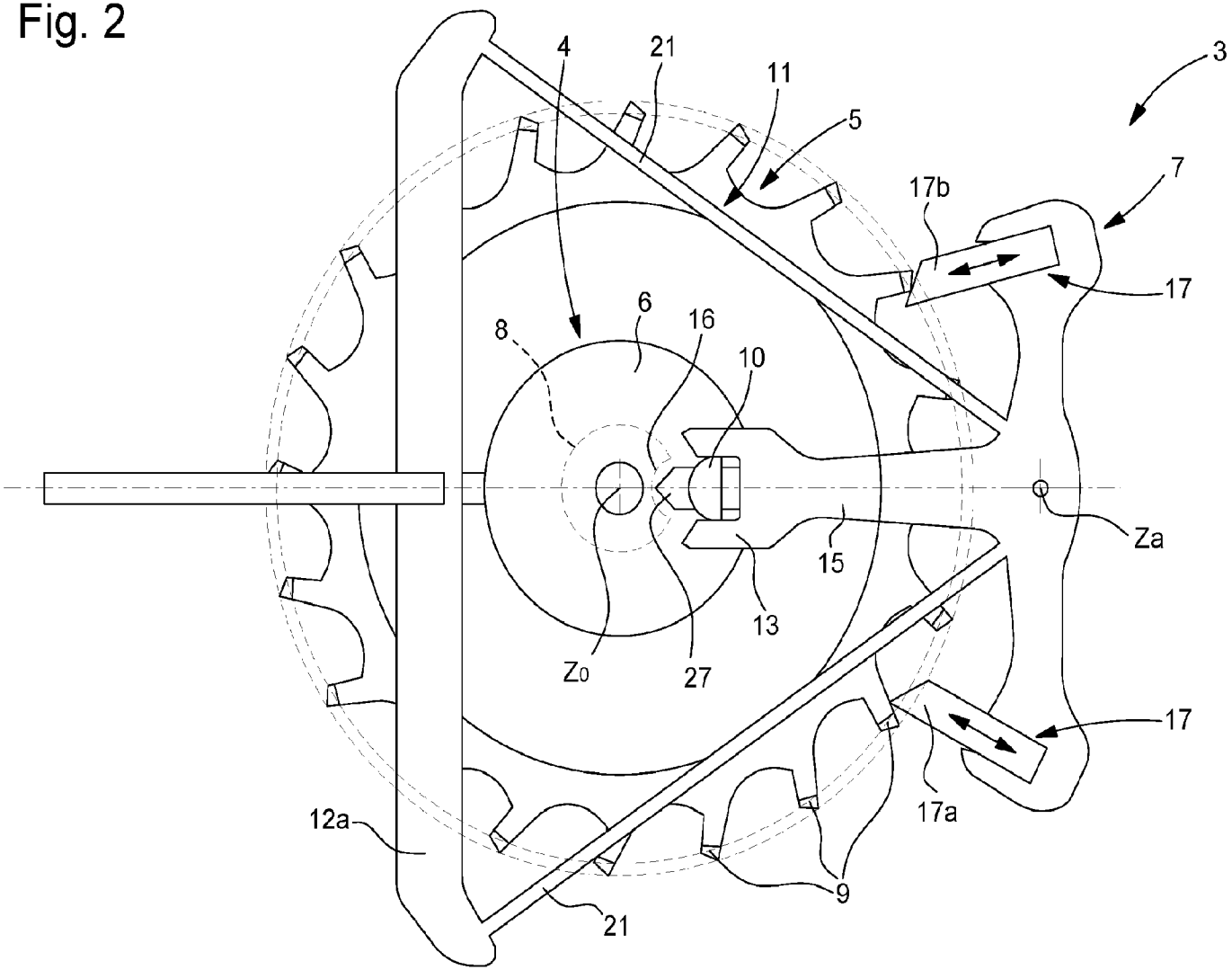
FIG. 2 is a view of a part of an escapement of a tourbillon mechanism for a timepiece movement according to an embodiment of the invention.
Figure 3:
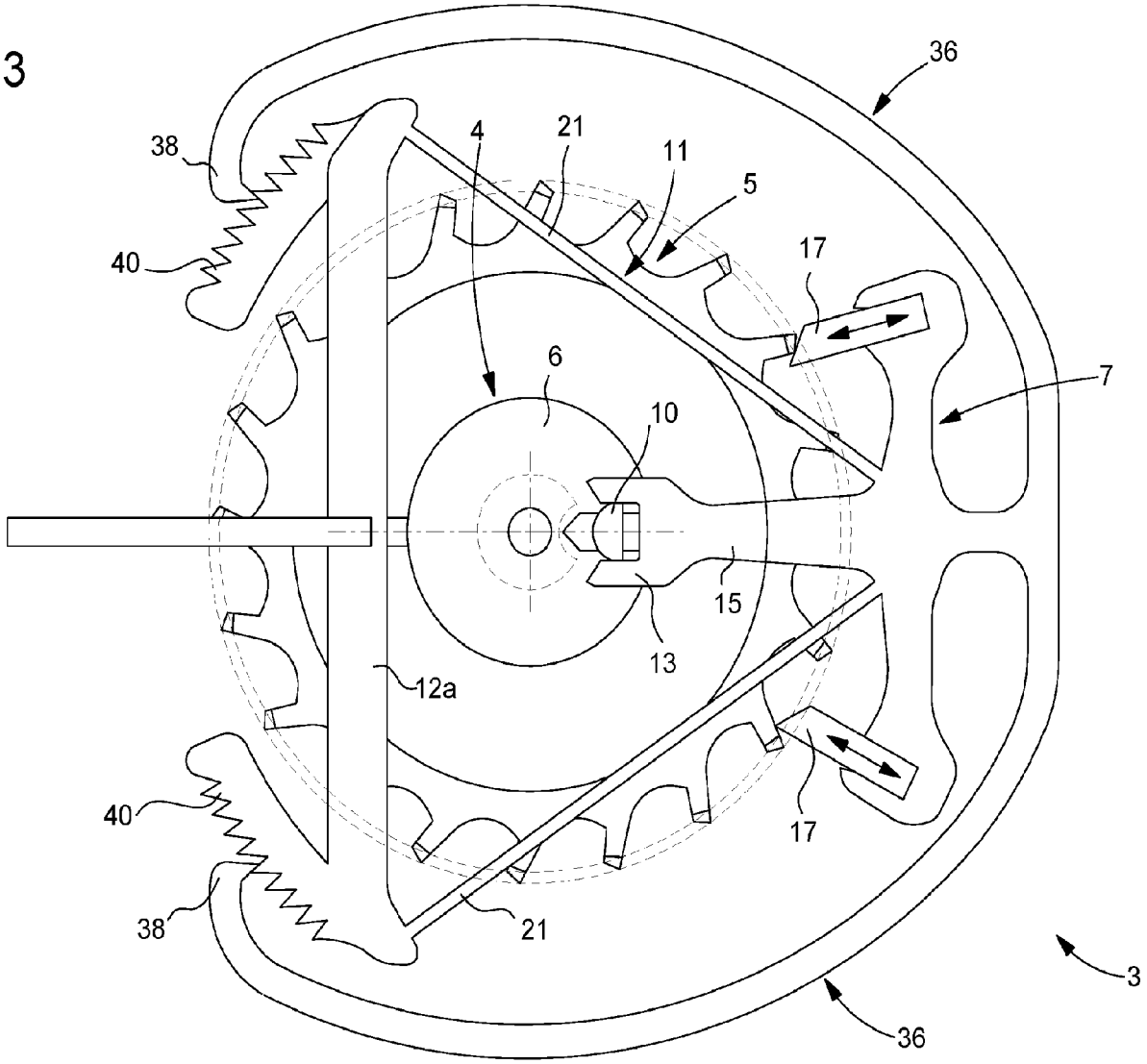
FIG. 3 is a view of a part of an escapement of a tourbillon mechanism for a timepiece movement according to another embodiment of the invention.

In some embodiments, such as those illustrated in FIGS. 1 to 3, pivot device 11 includes an anchoring area 12*a*, and one or more elastic arms 21 coupling pallet-lever 7 to anchoring area 12*a*.

The anchoring area may be secured directly to body 28 of carriage 12, or to a member statically secured to carriage 12. In a variant, anchoring area 12*a* may also be formed integrally with body 28 of carriage 12. Pallet-lever 7 may advantageously be formed integrally with elastic arm or arms 21.

In an advantageous embodiment, the pivot device includes at least two elastic arms 21 connected on either side of lever 15 of the pallets. In the illustrated variant, the at least two elastic arms 21 essentially form a triangle with anchoring area 12*a*. The elastic arms may advantageously be disposed in an essentially orthogonal plane to virtual axis of rotation $Z_a$ of the pallet-lever. The elastic arms may notably be made in the form of thin strips. Other shapes and configurations of the elastic arms are, however, possible within the scope of the invention provided that they fulfil the dual function of support and spring, to support the pallet-lever and simultaneously allow the pallet-lever to pivot for the escapement function. In the illustrated embodiment, pivot device 11 thus serves as spring and support for pallet-lever 7 pivoting about axis of rotation $Z_a$, with no requirement for another pivot or support for the pallet-lever. This advantageously makes it possible, amongst other things, to reduce losses due to friction in the bearings, and to reduce the size of the assembly comprising the pallet-lever and its support. Moreover, there is no need to lubricate the pivot.

Within the scope of the invention, it is also possible to have a pallet-lever comprising a pivot arbor supported by bearings integral with the carriage or attached to the carriage. The pivot arbor would be arranged in an aligned position with virtual axis of rotation $Z_a$ of the pallet-lever illustrated in FIGS. 1 to 3. In this variant (not illustrated), the pallet-lever pivot device may have a similar configuration to known pallet-lever pivots.

In the case of the variant of FIG. 1, the flexible pivot tends to return to the locking position. The angle of draw on the pallets must therefore be increased to guarantee draw. In short, the Swiss lever requires draw to operate correctly. Draw is achieved by tilting the locking-face of the pallets. Referring to FIG. 3, in one embodiment, pivot device 11 includes a bistable mechanism 26. With a bistable mechanism, bistability replaces the draw function and the pallets can have locking-faces that do not cause the escape wheel to recoil. In this variant, the bistable mechanism includes a pair of elastic draw elements 36, each coupled to one end of pallet-lever 7, and each comprising, at the other end, a hook 38 engaging the teeth of a ratchet 40 (with wolf-teeth). To create bistability with this type of flexible pivot, it is necessary to apply a load which provokes the buckling of the beams of the flexible guide member. Hook system 38 can adjust the buckling preload of the flexible guide member in order to find the preload that makes the system bistable. Within the scope of the invention, other bistable forms of construction may be used.

In this variant with a bistable pivot mechanism, angles of draw on the pallet-stones can be reduced or eliminated since this function is fulfilled by the bistability of the pivot mechanism. This makes it possible to increase the efficiency of the escapement system.

Advantageously, according to one embodiment, pivot device 11 or a set of elements integral with the pivot device such as part 15, 13 of pallet-lever 7 or the entire pallet-lever, and/or also a part of carriage 12, or the entire carriage, and/or also spring 14 of the balance mechanism may be formed by deposition or etching methods.

In some embodiments, the pivot device or set of integral elements may notably be formed of precious or non-precious metal, typically by the electroforming technique known under the abbreviation LIGA from the German terms "RöntgenLithographie, Galvanoformung & Abformung" and wherein a mould is filled to one or more levels with a metal, for example, by means of Ni or NiP electroplating. Of course, any type of electroforming, capable of forming the assembly or part of the pivot device described above may be envisaged.

In some embodiments, the pivot device or set of integral elements may advantageously form a one-piece structure.

In some embodiments, the pivot device or set of integral elements may notably be made of a silicon-based material.

In some embodiments, the pivot device or set of integral elements may notably be formed by a silicon-on-insulator (SOI) method. In this variant, the structure is formed of a stack of a silicon layer on an insulator layer. This insulator may be for example silicon dioxide (SiO2). The SOI wafer undergoes several successive etches through masks of suitable shape. The etches may be wet or dry etches. Typically, a deep reactive ion etch ("DRIE") will be used.

In some embodiments, the pivot device or set of integral elements may be made of amorphous metal.

The pivot device or set of integral elements may also comprise sacrificial structures to assist assembly. The invention advantageously makes it possible to improve the operation of a tourbillon mechanism compared to conventional solutions by eliminating a wheel set from the carriage of the tourbillon mechanism. The resulting tourbillon mechanism may therefore be much flatter since there is one less wheel set and efficiency is improved since inertia is lower. Indeed, the tourbillon mechanism according to embodiments of the invention may have lower inertia due to its smaller number of components. In a variant using the bistability of the flexible guide member, this reduces draw on the pallet-stones and reduces or eliminates recoil, which improves efficiency.

LIST OF REFERENCES

Timepiece movement
22 Frame
30 Bearings
24 Drive train
1 Tourbillon mechanism
2 Balance mechanism
14 Spring
16 Balance wheel
18 Arbor
20 Ends
3 Escapement mechanism
5 Escape wheel
9 Tooth
7 Pallet-lever
11 Pivot device
21 Elastic arm
12*a* Support element
26 Bistable mechanism
36 Elastic draw element
38 Hook
40 Ratchet teeth
12*a* Anchoring area
13 Fork
27 Guard-pin
15 Lever
17 Pallet-stones
Entry pallet 17*a*
Exit pallet 17*b*
4 Roller device
6 Roller
10 Impulse pin
8 Safety-roller
Notch
12 Carriage
28 Body
28*a*, 28*b* walls
26 Bearings
32 Escape pinion
34 Fourth wheel
$Z_0$ Axis of rotation of the tourbillon device
$Z_a$ Virtual axis of rotation of the pallet-lever

What is claimed is:

1. A tourbillon mechanism for a timepiece movement, comprising:

a balance mechanism;

an escapement mechanism; and a carriage mounted in a structure of the timepiece movement in rotation about a tourbillon axis, the balance mechanism comprising a spring and a balance wheel mounted in the carriage to pivot about said tourbillon axis, the escapement mechanism comprising an escape wheel with teeth and a pallet-lever comprising pallet-stones configured to engage said teeth, the pallet-lever being mounted in the carriage and coupled in rotation to the carriage through a pivot device, wherein the escape wheel encircles the tourbillon axis and is attached to or integral with said structure of the timepiece movement and the pivot device is configured to pivot elastically and to support the pallet-lever, and wherein the pivot device includes one or more elastic arms connecting the pallet-lever to an anchoring area attached to, or integral with the carriage.

2. The mechanism according to claim 1, wherein a pair of elastic arms form an essentially triangular shape with the anchoring area.

3. The mechanism according to claim 1, wherein the pallet-lever pivots about a virtual axis of rotation located at an intersection of neutral fibres of the elastic arms.

4. The mechanism according to claim 1, wherein the teeth of the escape wheel point outwards from the wheel and the pallet-stones are disposed radially on an outside of the escape wheel and point towards an inside of the wheel.

5. The mechanism according to claim 1, wherein the carriage is connected to an energy source providing a rotational torque on the carriage, the energy source being coupled to the carriage through a drive train meshing with a pinion that is attached to or integral with the carriage.

6. The mechanism according to claim 1, wherein the pivot device or a set of elements integral with the pivot device are formed by deposition or etching methods.

7. The mechanism according to claim 6, wherein the set of elements integral with the pivot device includes one or more of the following elements: part of the pallet-lever or the entire pallet-lever; part of the carriage or the entire carriage; and the spring of the balance mechanism.

8. The mechanism according to claim 6, wherein the pivot device or the set of elements integral with the pivot device form a one-piece structure.

9. The mechanism according to claim 8, wherein the pivot device or the set of elements integral with the pivot device are made of one or more of the following materials: silicon-based material, Ni, NiP, and amorphous metal.

10. The mechanism according to claim 6, wherein the deposition method comprises a LIGA electroforming method.

11. The mechanism according to claim 1, wherein the pivot device includes a bistable mechanism.

12. A watch movement including a mechanism according to claim 1.

13. A tourbillon mechanism for a timepiece movement, comprising:

a balance mechanism;

an escapement mechanism;

a carriage mounted in a structure of the timepiece movement in rotation about a tourbillon axis, the balance mechanism comprising a spring and a balance wheel mounted in the carriage to pivot about said tourbillon axis, the escapement mechanism comprising an escape wheel with teeth and a pallet-lever comprising pallet-stones configured to engage said teeth, the pallet-lever being mounted in the carriage and coupled in rotation to the carriage through a pivot device; and a pair of elastic strips arranged to symmetrically connect an anchoring area to the pallet-lever and configured to allow pivoting of the pallet-lever.

* * * * *